US010159354B2

(12) United States Patent
Rayburn et al.

(10) Patent No.: US 10,159,354 B2
(45) Date of Patent: Dec. 25, 2018

(54) PORTABLE HEADREST

(71) Applicant: DBDI, LLC, North Canton, OH (US)

(72) Inventors: Donald Rayburn, North Canton, OH (US); William Raftery, North Canton, OH (US)

(73) Assignee: DBDI, LLC, North Canton, OH (US)

( * ) Notice: Subject to any disclaimer, the term of this patent is extended or adjusted under 35 U.S.C. 154(b) by 0 days.

(21) Appl. No.: 15/277,689

(22) Filed: Sep. 27, 2016

(65) Prior Publication Data

US 2018/0084919 A1 Mar. 29, 2018

(51) Int. Cl.

| | |
|---|---|
| ***A47C 16/00*** | (2006.01) |
| ***A47G 9/10*** | (2006.01) |
| ***A47C 7/38*** | (2006.01) |
| *A47G 9/00* | (2006.01) |

(52) U.S. Cl.

CPC ..... *A47C 16/00* (2013.01); *A47C 7/383* (2013.01); *A47G 9/1027* (2013.01); *A47G 2009/003* (2013.01)

(58) Field of Classification Search

CPC ..... A47C 16/00; A47C 7/383; A47G 9/1027; A47G 2009/003

See application file for complete search history.

(56) References Cited

U.S. PATENT DOCUMENTS 245,639 A * 8/1881 Lay ..... B60N 2/4879 248/118
1,260,929 A * 3/1918 Maxcy ..... B60N 2/4879 188/5
2,120,310 A * 6/1938 Duncan ..... A01N 1/00 248/124.1
4,235,472 A * 11/1980 Sparks ..... A45C 9/00 108/43
4,249,712 A * 2/1981 DeLong ..... B44D 3/00 248/118
4,928,336 A * 5/1990 Petillo, Sr. ..... A47G 9/1027 5/644
5,177,823 A * 1/1993 Riach ..... A47C 7/38 297/408
5,408,713 A * 4/1995 Stratton ..... A47C 16/00 5/622
5,645,319 A * 7/1997 Parks, Jr. ..... A47C 7/383 297/146
6,081,947 A * 7/2000 Disher ..... A47C 20/026 248/118.3
6,148,460 A * 11/2000 Fried ..... A61G 13/009 5/622
6,151,734 A * 11/2000 Lawrie ..... A47C 20/026 5/622
6,305,749 B1 * 10/2001 O'Connor ..... A47C 7/383 297/397
6,427,273 B1 * 8/2002 Berke ..... A47C 16/00 248/118

(Continued)

FOREIGN PATENT DOCUMENTS

GB 2524569 A * 9/2015 ..... A47C 20/026
WO WO-2013120207 A1 * 8/2013 ..... A47C 16/00

*Primary Examiner* — James M Ference
(74) *Attorney, Agent, or Firm* — Black, McCuskey, Souers & Arbaugh, LPA

(57) ABSTRACT

Described in an example embodiment herein is a portable headrest. The portable headrest may be deployed on a surface in front of a user, such as a tray table on an aircraft or a desk.

16 Claims, 7 Drawing Sheets

(56) References Cited

U.S. PATENT DOCUMENTS 6,857,149 B2 * 2/2005 Hoggatt ..... A47C 20/026 5/632
7,036,168 B1 * 5/2006 Knickerbocker ..... A47G 9/10 5/636
7,303,237 B1 * 12/2007 Hughes ..... B60N 2/4879 297/181
7,364,129 B1 * 4/2008 Levari, Jr. ..... A45C 13/00 108/4
7,673,836 B2 * 3/2010 Wallock ..... A47C 16/00 248/118
7,909,406 B2 * 3/2011 Samuelsen ..... A47C 7/383 297/392
8,011,731 B2 * 9/2011 Goddu ..... A47C 7/383 297/392
8,528,970 B2 * 9/2013 Edalati ..... A47C 20/026 297/163
8,826,581 B2 * 9/2014 Boll ..... A01M 31/02 42/94
8,850,642 B2 * 10/2014 Rasmussen ..... A47G 9/1027 297/398
8,905,207 B2 * 12/2014 Hamilton ..... A45C 13/262 190/1
9,150,130 B2 10/2015 Jackow
9,375,091 B1 * 6/2016 Baker ..... A47C 7/383
9,498,056 B1 * 11/2016 Mills ..... A47C 7/383
2001/0008214 A1 * 7/2001 Matthews ..... A47C 7/383 206/303
2002/0050009 A1 * 5/2002 Ley ..... A47C 16/00 5/657
2002/0100846 A1 * 8/2002 Tinsley ..... A61G 13/12 248/118
2004/0262865 A1 * 12/2004 Sigler ..... A47C 16/00 280/47.27
2005/0109346 A1 * 5/2005 Cohen ..... A47C 20/026 128/845
2010/0325802 A1 * 12/2010 Schwartz ..... A61G 13/009 5/638
2010/0325803 A1 * 12/2010 Requena ..... A47G 9/10 5/640
2011/0169316 A1 * 7/2011 Goei ..... A47C 7/383 297/391
2012/0278993 A1 * 11/2012 Gard ..... A47C 20/026 5/640
2013/0232696 A1 * 9/2013 Halimi ..... A47C 16/00 5/640
2014/0310877 A1 * 10/2014 Sternlight ..... A47G 9/10 5/639
2014/0312186 A1 * 10/2014 Mech ..... A47C 20/026 248/118
2015/0001905 A1 * 1/2015 Jackow ..... B60N 2/4805 297/397
2016/0081482 A1 * 3/2016 Schumacher ..... A47C 7/383 5/640
2016/0113407 A1 * 4/2016 Sampson ..... A47C 7/383 297/397
2017/0354263 A1 * 12/2017 Houghson ..... F16M 11/28

* cited by examiner

PORTABLE HEADREST

TECHNICAL FIELD

The present disclosure relates generally to portable or mobile headrests.

BACKGROUND

Headrests provide support to the head of a user. This can aid in comfort of the user and may facilitate sleep.

BRIEF DESCRIPTION OF THE DRAWINGS

The accompanying drawings incorporated herein and forming a part of the specification illustrate the example embodiments.

OVERVIEW OF EXAMPLE EMBODIMENTS

Figure 1:
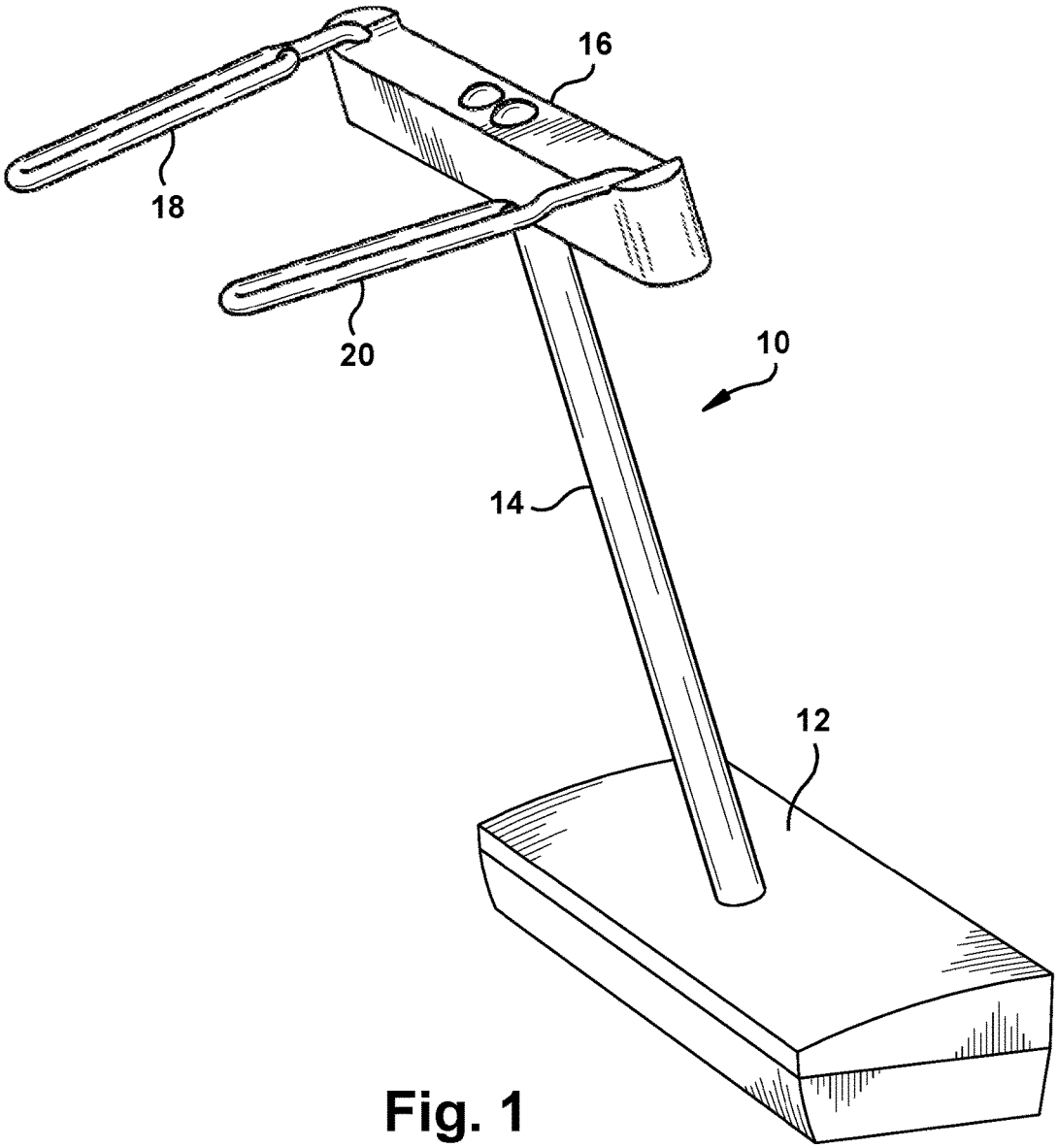
FIG. 1 is a perspective view illustrating an example of a portable headrest.

The following presents a simplified overview of the example embodiments in order to provide a basic understanding of some aspects of the example embodiments. This overview is not an extensive overview of the example embodiments. It is intended to neither identify key or critical elements of the example embodiments nor delineate the scope of the appended claims. Its sole purpose is to present some concepts of the example embodiments in a simplified form as a prelude to the more detailed description that is presented later.

In accordance with an example embodiment, there is disclosed herein, an apparatus comprising a base, a support having a first end coupled with the base, an upper frame piece coupled to a second end of the base, and a pair of arms coupled with the upper frame piece. A pillow is mounted on the upper frame piece and two arms.

DESCRIPTION OF EXAMPLE EMBODIMENTS

This description provides examples not intended to limit the scope of the appended claims. The figures generally indicate the features of the examples, where it is understood and appreciated that like reference numerals are used to refer to like elements. Reference in the specification to "one embodiment" or "an embodiment" or "an example embodiment" means that a particular feature, structure, or characteristic described is included in at least one embodiment described herein and does not imply that the feature, structure, or characteristic is present in all embodiments described herein.

FIG. 1 is a perspective view illustrating an example of a portable headrest 10. The portable headrest 10 comprises a base 12. As will be described in further detail herein infra, in particular embodiments the base 12 may be employed as a storage for the components of the portable headrest when not in use. The base 12 is coupled to one end of a support 14. The other end of support 14 is coupled with an upper frame piece 16. Two arms 18 are coupled with the upper frame piece 16.

In an example embodiment, the arms 18, 20 are pivotally mounted to upper frame piece 16. This can allow the arms 16, 18 to be folded in for storage (see e.g., FIG. 8).

Figure 2:
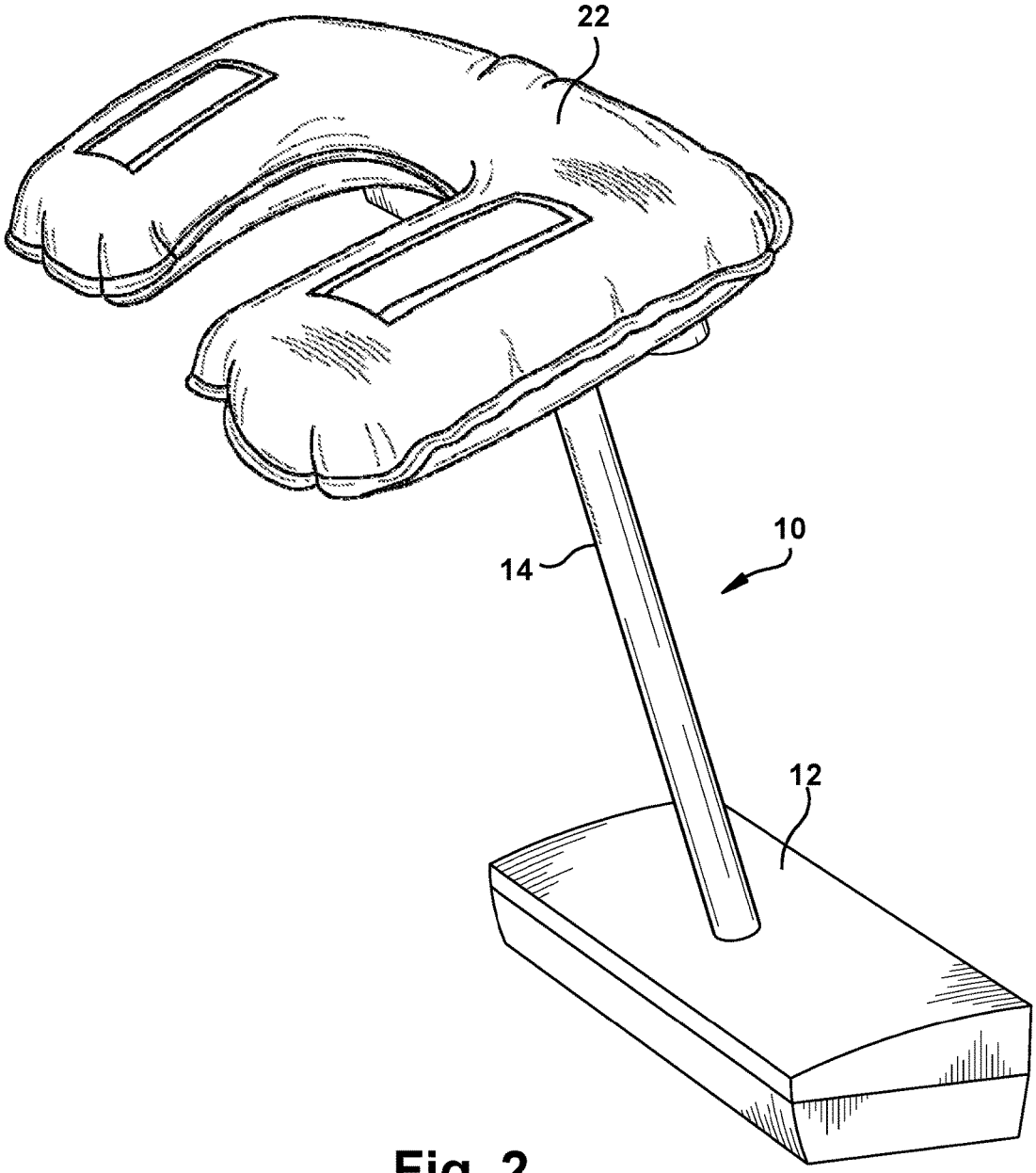
FIG. 2 is a perspective view illustrating an example of a portable headrest illustrated in FIG. 1 with a pillow attached.

FIG. 2 is a perspective view illustrating an example of a portable headrest 10 illustrated in FIG. 1 with a pillow 22 attached. The pillow 22 is mounted onto the upper frame piece 16 and arms 16, 18 illustrated in FIG. 1.

As those skilled in the art can readily appreciate, the portable headrest can be installed on a surface in front of a user, such as for example, a tray on the rear of an airplane seat or a desk. The user may then lean forward and the pillow 22 will support the user's head. Areas in the middle of the user's face, such as the mouth, nose, and eyes, fit in the space between the arms 16, 18.

Figure 3:
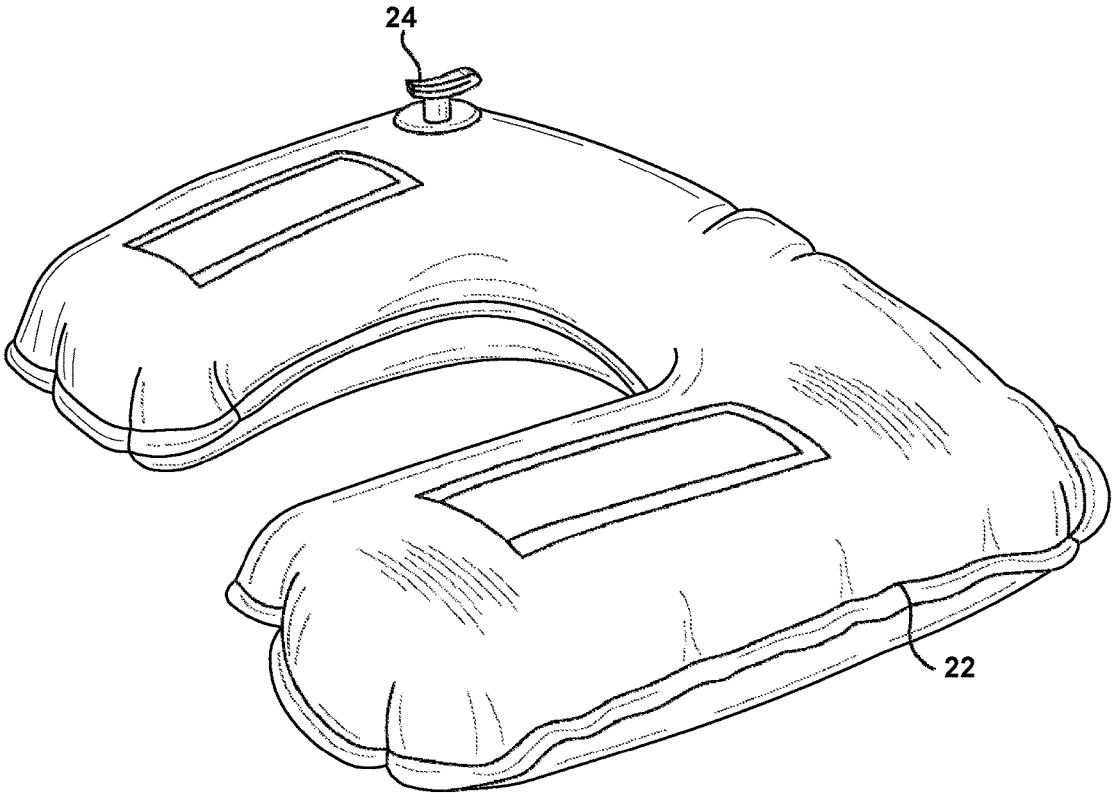
FIG. 3 is a perspective view of a pillow suitable for use with the portable headrest in FIG. 1.

FIG. 3 is a perspective view of a pillow suitable 22 for use with the portable headrest in FIG. 1. The pillow 22 comprises a valve 24 that allows a user blow the pillow 22 up with air, or to release the air from the pillow 22 so that the pillow can be easily stored when not in use.

Figure 4:
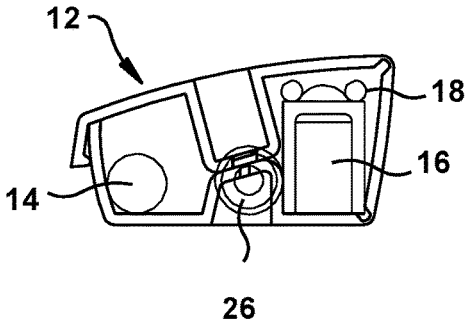
FIG. 4 is a side view illustrating an example of the base of the headrest being employed to store the components of the headrest while not in use.

FIG. 4 is a side view illustrating an example of the base 22 of the headrest being employed to store the components of the headrest while not in use. The components of the headrest further comprise an extender 26. The extender 26 may be employed to adjust the length of the support 14 (e.g., can increase the distance between the base 12 and the upper frame piece 16).

Figure 5:
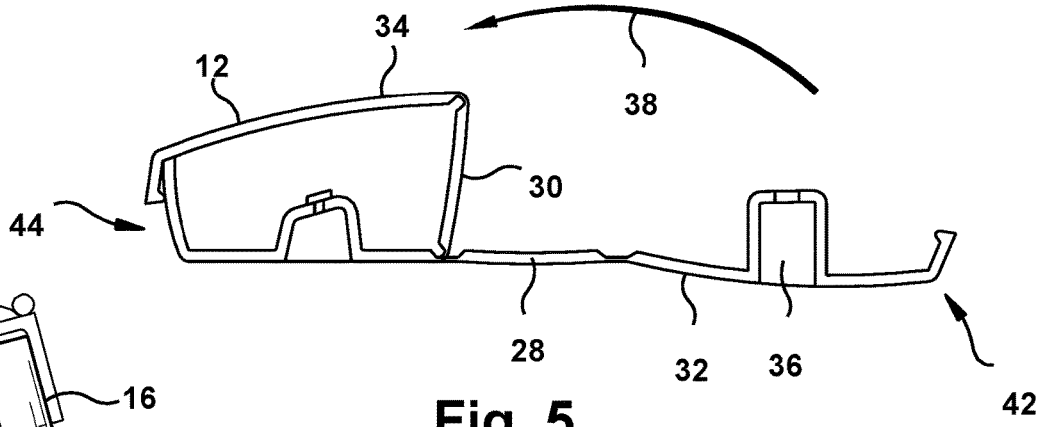
FIG. 5 illustrates example of how the lid of the base illustrated in FIG. 1 can be reconfigured to an operational position.

FIG. 5 illustrates example of how the lid of the base 12 illustrated in FIG. 1 can be reconfigured to an operational position. The lid comprises a first section 32 that is sized to comport to side 30 of the base 12, and a second section 32 that is sized to comport to a section 34 of lid 12 so that the cavity 36 in the lid is properly positioned. The lid is rotated in the direction of arrow 38 to reconfigure the base 12 to the operational position. To access the interior of the base 12, the lid is moved in a direction opposite of arrow 38. Another section 42 of the lid engages side 44 of the base 12 when the lid is closed. The components of the portable headrest can then be assembled as illustrated in FIGS. 1, 2 and 6.

Figure 6:
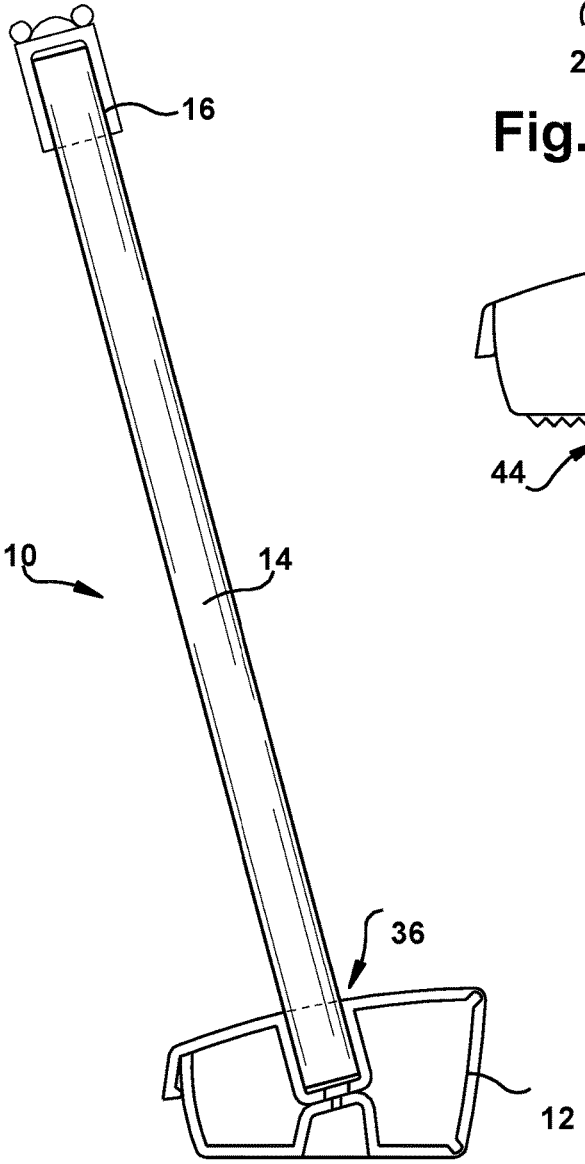
FIG. 6 illustrates an example of a base with a gripping surface on the bottom of the base.

FIG. 6 illustrates an example of a side view of the portable headrest 10. This view illustrates how support 14 is inserted into cavity 36.

Figure 7:
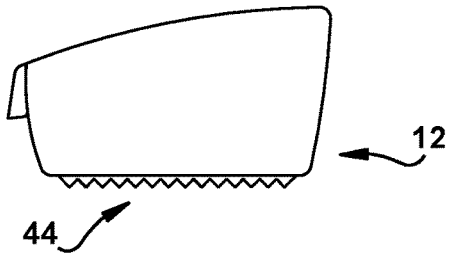
FIG. 7 illustrates an example of a side view of the portable headrest.

FIG. 7 illustrates an example of a base 12 with a gripping surface 44 on the bottom of the base. The gripping surface may be comprised of a rubber-like material. or elastomer, such as for example polypropylene. The illustrated example also shows gripping surface as having raised surfaces and grooves, however, those skilled in the art can readily appreciate that any suitable configuration can be employed.

Figure 8:
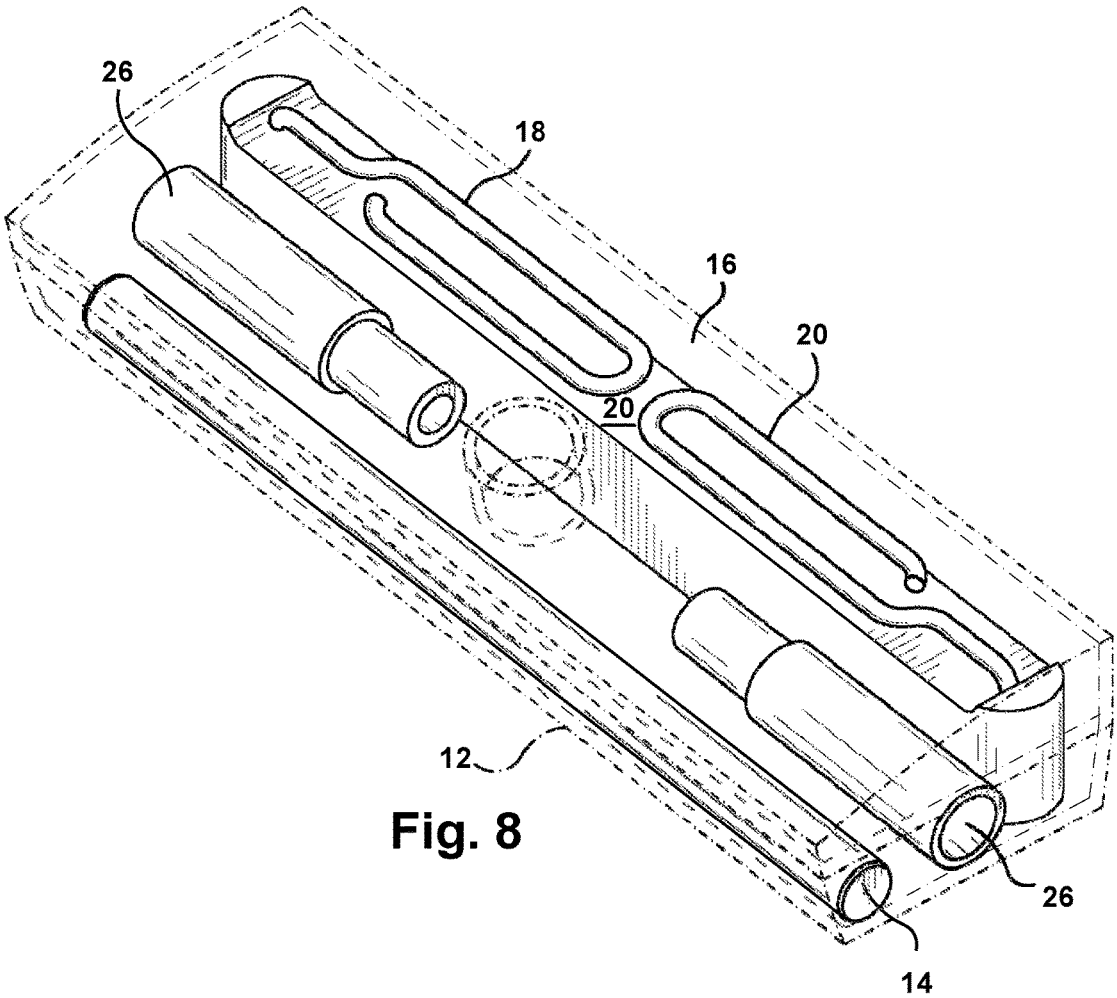
FIG. 8 is a perspective view of the interior of the base of the portable headrest with the components stored therein.

FIG. 8 is a perspective view of interior of the base 12 of the portable headrest with the dissembled components stored therein. In the illustrated example, two extenders 26 are stored therein, however, those skilled in the art can readily appreciate that any physically realizable number of extenders may be stored in the base 12, In an example embodiment, the base 12 has at least one surface that is transparent or translucent material.

Figure 9:
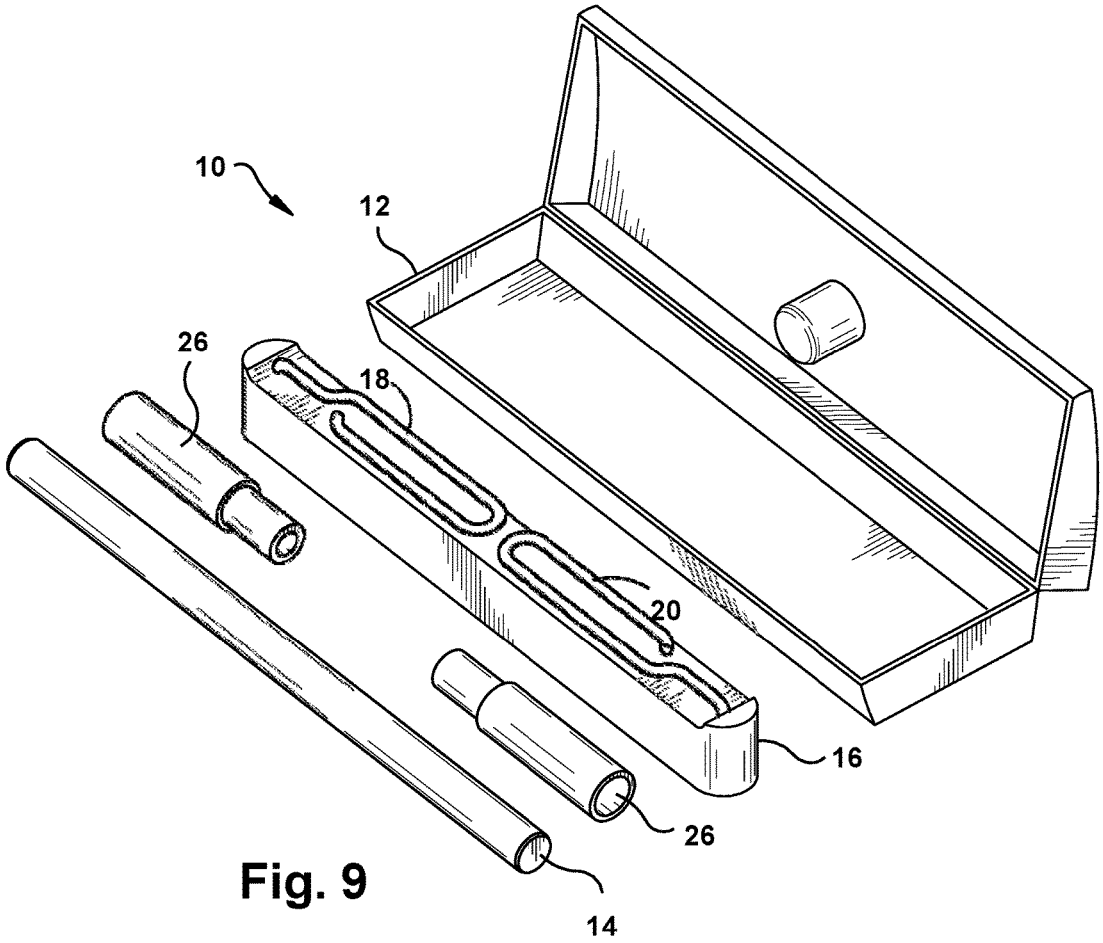
FIG. 9 illustrates an example of the dissembled components of the portable headrest.

FIG. 9 illustrates an example of the dissembled components of the portable headrest 10. In this example, the upper frame piece 16 with arms 16, 18 folded in, the extenders 26, and support 14 are outside of the base 12.

Figure 10:
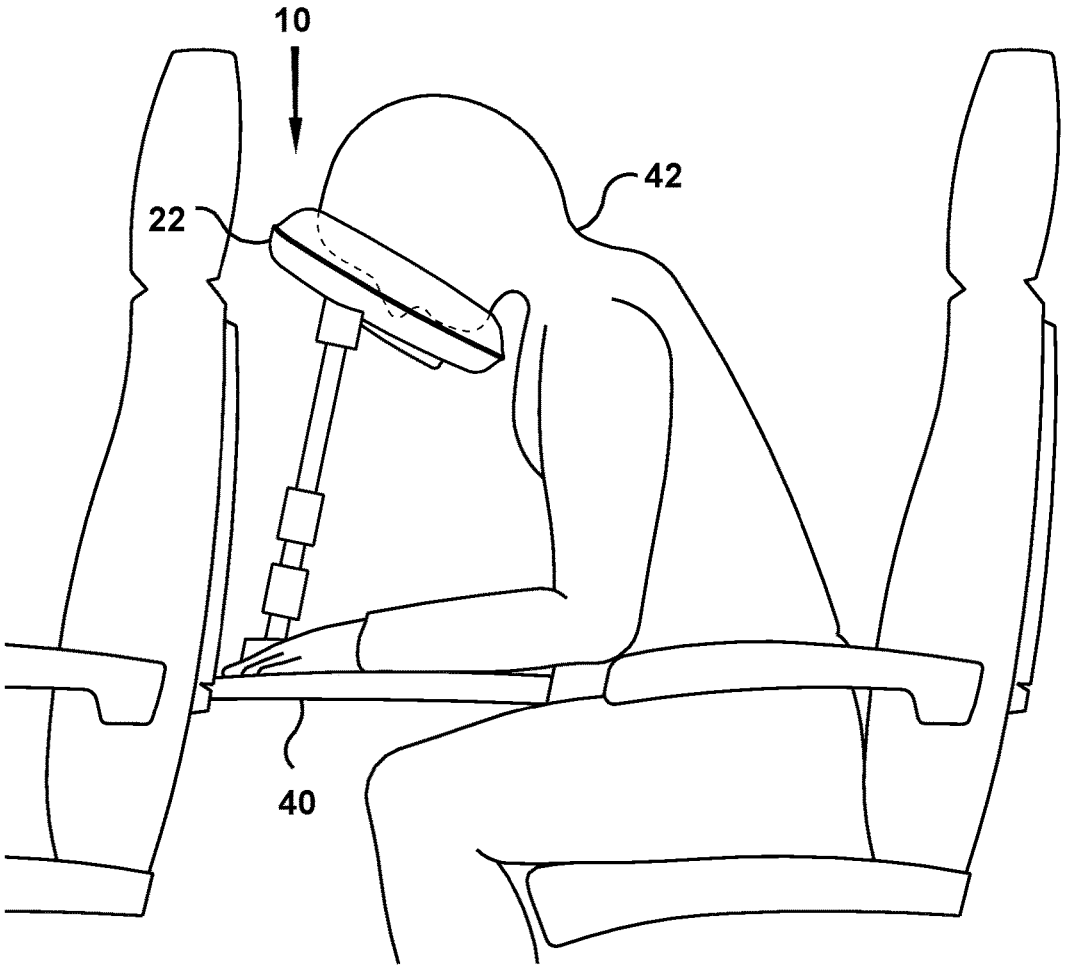
FIG. 10 illustrates an example perspective view of the portable headrest.

FIG. 10 illustrates an example perspective view of the portable headrest 10. In the illustrated example, the portable headrest is on top of a seatback, tray table 40. The user's head 42 is resting against the pillow 22.

Described above are example embodiments. It is, of course, not possible to describe every conceivable combination of components or methodologies, but one of ordinary skill in the art will recognize that many further combinations and permutations of the example embodiments are possible. Accordingly, this application is intended to embrace all such alterations, modifications and variations that fall within the spirit and scope of the appended claims interpreted in accordance with the breadth to which they are fairly, legally and equitably entitled.

The invention claimed is:

1. An apparatus, comprising:

a base having an interior with a cavity on one surface;

a support having a first end coupled with the base, the first end of the support being inserted into the cavity;

an upper frame piece coupled to a second end of the support;

a pair of arms coupled with the upper frame piece, wherein the arms are pivotally mounted onto the upper frame piece, wherein the arms pivot along an axis that is perpendicular to a longitudinal axis of the upper frame piece, wherein the arms are operable to rotate to a first position where the arms extend away from the upper frame piece and fold to a second position where the arms are aligned with the upper frame piece; and a pillow mounted on the upper frame piece and the pair of arms, wherein the interior of the base is of sufficient size to store the support, the upper frame piece, and the pair of arms in the interior of the base when the support, the upper frame piece and the pair of arms are not in use; and wherein the base comprises a lid with a first section corresponding to a side of the base, and a second section for positioning the cavity that receives the support.

2. The apparatus set forth in claim 1, wherein the pillow is U shaped.

3. The apparatus set forth in claim 2, wherein the pillow comprises an air valve allowing air to be employed to inflate the pillow.

4. The apparatus set forth in claim 1, wherein the lid further comprises a third section for engaging the side of the base.

5. The apparatus set forth in claim 1, wherein the base further comprises a gripping surface on a side of the base that is opposite where the support is inserted.

6. The apparatus set forth in claim 1, further comprising an extender coupled with the support, the extender for adjusting distance between the upper frame piece and the base.

7. The apparatus set forth in claim 1, wherein at least one surface of the base is transparent.

8. The apparatus set forth in claim 1, wherein at least one surface of the base is translucent.

9. An apparatus, comprising:

a base having an interior and a gripping surface on a bottom surface of the base;

a lid coupled with the base, the lid having a cavity that when the lid is closed extends into the interior of the base on a surface that is opposite the bottom surface;

a support having a first end coupled with the base, the first end of the support being inserted into the cavity;

an upper frame piece coupled to a second end of the support;

a pair of arms coupled with the upper frame piece, wherein the arms are pivotally mounted onto the upper frame piece, wherein the arms pivot along an axis that is perpendicular to a longitudinal axis of the upper frame piece, wherein the arms are operable to rotate to a first position where the arms extend away from the upper frame piece and fold to a second position where the arms are aligned with the upper frame piece; and a pillow mounted on the upper frame piece and the pair of arms.

10. The apparatus set forth in claim 9, wherein the pillow comprises an air valve allowing air to into the interior of the pillow to inflate the pillow and air to exit the interior of the pillow to deflate the pillow.

11. The apparatus set forth in claim 9, wherein the interior of the base is a sufficient size to store the support, upper frame piece, and arms in the interior of the base when they are not in use.

12. The apparatus set forth in claim 9, wherein the lid further comprises a first section corresponding to a side of the base, and a second section for positioning the cavity that receives the support.

13. The apparatus set forth in claim 12, wherein the lid further comprises a third section for engaging a side of the base.

14. The apparatus set forth in claim 9, wherein the arms are pivotally mounted onto the upper frame piece.

15. The apparatus set forth in claim 14, wherein the pillow is U shaped and fits over the arms while the arms are extended.

16. The apparatus set forth in claim 9, further comprising an extender coupled with the support, the extender for adjusting a distance between the upper frame piece and the base.

* * * * *